US012578099B2

(12) United States Patent
Storm

(10) Patent No.: US 12,578,099 B2
(45) Date of Patent: Mar. 17, 2026

(54) SYSTEMS AND METHODS FOR REDUCING CONDENSATION ON BUILDING WATER SUPPLY LINES

(71) Applicant: Storm Innovations LLC, Clear Lake, WI (US)

(72) Inventor: Peter Storm, Clear Lake, WI (US)

( * ) Notice: Subject to any disclaimer, the term of this patent is extended or adjusted under 35 U.S.C. 154(b) by 274 days.

(21) Appl. No.: 18/462,179

(22) Filed: Sep. 6, 2023

(65) Prior Publication Data

US 2024/0077212 A1 Mar. 7, 2024

Related U.S. Application Data

(60) Provisional application No. 63/374,847, filed on Sep. 7, 2022.

(51) Int. Cl.
*F24D 19/10* (2006.01)

(52) U.S. Cl.
CPC .. *F24D 19/1051* (2013.01); *F24D 2220/0271* (2013.01); *F24D 2220/042* (2013.01)

(58) Field of Classification Search
CPC ..... F24D 19/1051; F24D 2220/0271; F24D 2220/042
See application file for complete search history.

(56) References Cited

U.S. PATENT DOCUMENTS 4,526,011 A * 7/1985 Logan ..... H05K 7/20281 340/602
9,878,565 B1 * 1/2018 McConville ..... B41J 2/442
11,092,347 B2 8/2021 Fischer et al.
2012/0216992 A1 * 8/2012 So ..... H05K 5/0212 165/138

OTHER PUBLICATIONS

Patent Cooperation Treaty, International Search Report, App. No. PCT/US2023/032107, Feb. 9, 2024, 6 pgs.
Patent Cooperation Treaty, Written Opinion of the International Searching Authority, App. No. PCT/US2023/032107, Feb. 9, 2024, 10 pgs.

* cited by examiner

*Primary Examiner* — Jonathan Bradford
(74) *Attorney, Agent, or Firm* — Carlson, Caspers, Vandenburgh & Lindquist, P.A.

(57) ABSTRACT

An apparatus for reducing condensation on water lines has a sensor for measuring dew point of ambient air, a first inlet for receiving cold water, a second inlet for receiving hot water, and an outlet. Further, the apparatus has a manifold in fluid communication with the first inlet, the second inlet, and the outlet, a valve for controlling the flow of hot water from the second inlet into the manifold, and an actuator configured to adjust the valve. The apparatus has a controller coupled to the first sensor and the actuator for controlling the actuator to adjust a quantity of hot water that is mixed with cold water at the outlet based on one or more dew point measurements from the sensor.

19 Claims, 8 Drawing Sheets

SYSTEMS AND METHODS FOR REDUCING CONDENSATION ON BUILDING WATER SUPPLY LINES

CROSS-REFERENCE TO RELATED APPLICATIONS

This application claims the benefit of priority to U.S. Provisional Patent Application No. 63/374,847, filed Sep. 7, 2022, the contents of which is incorporated by reference herein in its entirety.

BACKGROUND

Buildings are plumbed to provide running water to various locations therein. Water for the building is sourced from a location outside of the building such as a well or public water supply. A water service line enters the building, usually underground and then branches out into distribution lines running to the various locations inside the building. A single water distribution line can feed multiple different types of water for a building, including cold and hot water supplies as well as softened and unsoftened water. Many of these water distribution lines run through walls, floors, and ceilings where they are not easily accessible and there is little to no ventilation.

DESCRIPTION

Embodiments described herein provide systems and methods for reducing or preventing condensation on water lines inside a building. Condensation can occur when the temperature of a surface (e.g., the surface of water lines) is at or lower than the dew point of the air ambient the surface. Condensation on water lines results in the formation of liquid water on the lines which can result in mold or mildew formation on the surrounding materials such as drywall, wood and insulation, pipe corrosion, or rotting wood, among other things.

The discussion of plumbing systems herein may be made with reference to a residential plumbing system, but it should be understood that the systems disclosed herein could be used in the plumbing of any type of building or similar structure, including industrial buildings. Exemplary buildings in which the system can be implemented include single family homes, townhouses, apartment buildings, office buildings, schools, commercial buildings, hospitals, nursing homes, and other structures with running water.

Figure 1:
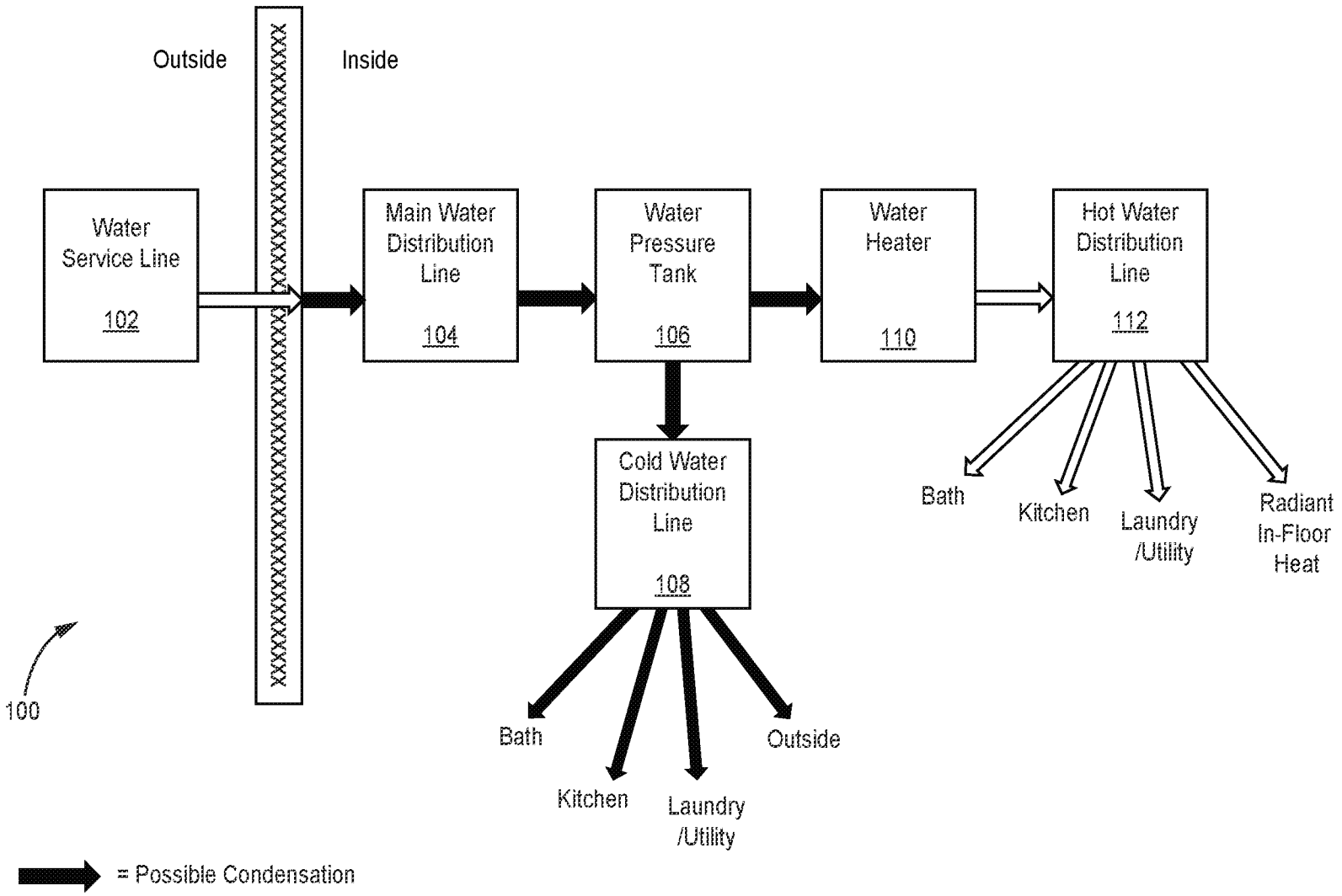
FIG. 1 is a block diagram of an example residential plumbing system.

FIG. 1 is a block diagram of a residential plumbing system 100. Water is supplied to a building from a water service line 102. A water service line 102 can provide water from any suitable water source including a residential or commercial well, a public water supply system (e.g., municipal water), a private water supply system, or other source or water service line. In a typical residential setting, water can sometimes enter a building through a water service line 102 at a lower temperature than the ambient dew point inside the building. Reasons for this can include the water being pumped from an aquifer by a well or being provided by underground lines, where the water temperature is lower than the ambient dew point inside the building. Water from the water service line 102, which is located outside of the building, is provided to a main water distribution line 104 located inside of the building. Water from the main water distribution line can optionally be provided to a water pressure tank 106, such as in houses with a well. Water from the main water distribution line 104 feeds a cold water distribution line 108 for distribution into the building where cold water is needed, such as (but not limited to) bathrooms, kitchens, laundry or utility rooms, and outdoors. Examples of applications connected to a cold water distribution line include bathtubs, showers, sinks, washing machines, outdoor water supplies (e.g., irrigation systems or water spigots), or any other application where cold water is needed. Water from the main water distribution line 104 can also be provided to a water heater 110. One or more water heaters 110 heats water from the main water distribution line 104 and supplies heated water to a hot water distribution line 112. The water heater 110 can comprise any device for heating water, such as a gas or electric water heater with or without a tank, as well as a solar water heater or any combination thereof. The hot water distribution line 112 provides hot water to any location where hot water is needed, such as bathrooms, kitchens, and laundry or utility rooms. Examples of hot-water line applications include bathtubs, showers, sinks, washing machines, radiant in-floor heat, or any other application where heated water is needed.

The conventional plumbing system 100 has a drawback in that the lines containing "cold" water which have not been heated by the water heater 110 (e.g., the main water distribution line 104 and cold water distribution line 108 and any line or application receiving cold water from the cold water distribution line 108) can have a temperature at or below the ambient dew point causing unwanted condensation to form and collect inside a building. More precisely, water vapor from the surrounding air can condense on cold water distribution lines and create unwanted wetness on the outside of the pipe and inside the structure, such as inside of walls where pipes run. The temperature of an outer surface of a water line is affected by the temperature of the water that flows through the line. Thus, water lines directing colder water (i.e., cold water distribution lines) are colder and water pipes directing warmer water are warmer. Because water from a water source is often at a relatively low temperature when it is provided by the water service line 102, the water in unheated water lines can be at a temperature at or below the dew point of the ambient air inside the building, resulting in a situation that is conducive to the formation of condensation. The unwanted wetness caused by condensation can create problems such as mold or mildew formation on building materials, pipe corrosion, or rotting wood among other things.

Figure 2:
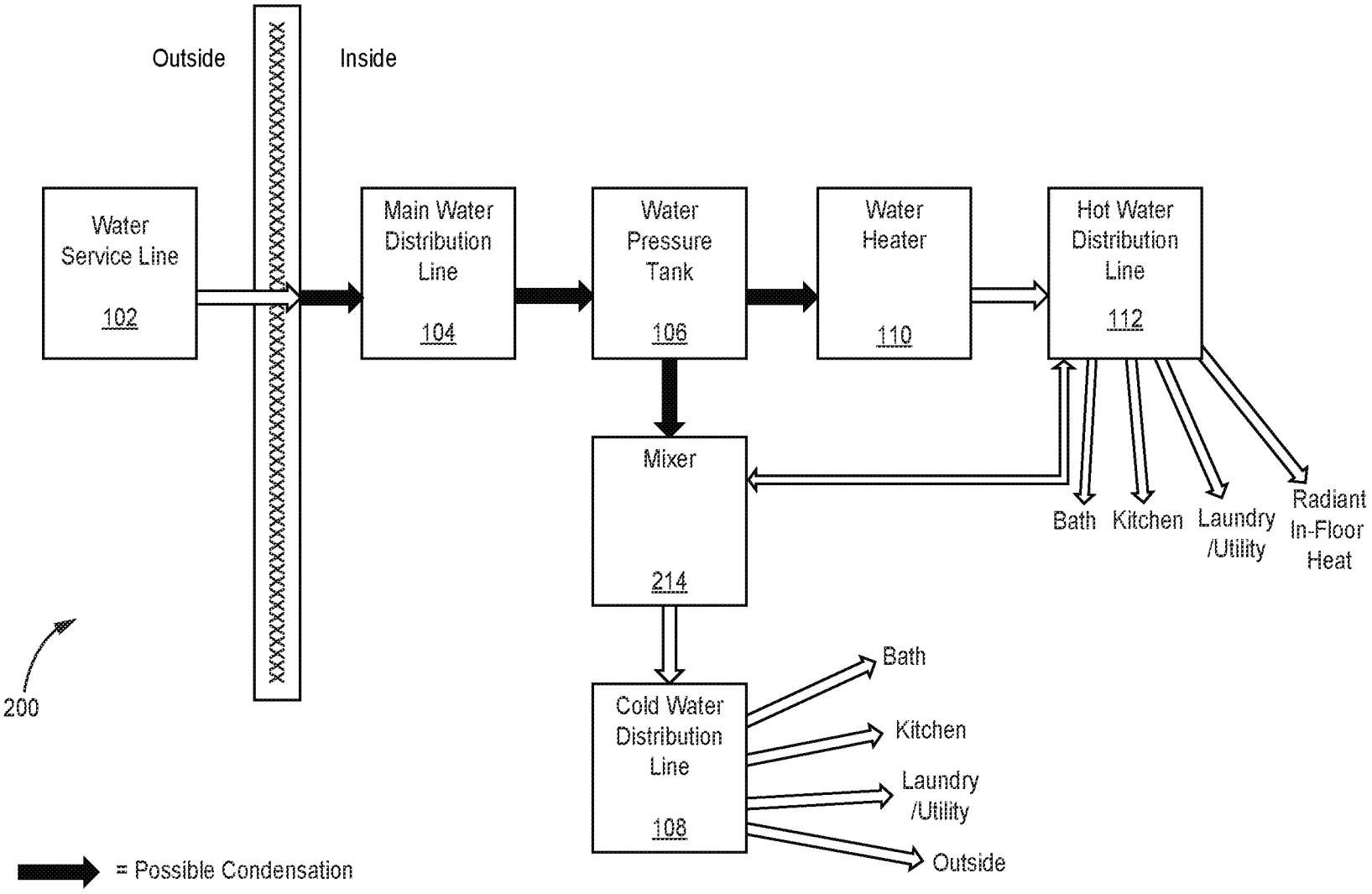
FIG. 2 is a block diagram of a first example plumbing system for reducing condensation.

FIG. 2 is a block diagram of an example system 200 for reducing or preventing condensation on water supply lines inside a building. The system 200 can include the components and lines of a standard plumbing system 100, such as a water supply line 102, main water distribution line 104, water pressure tank 106, cold water distribution line 108, water heater 110, and hot water distribution line 112. The system 200 can further include a mixer 214. The mixer 214 can combine hot water from the hot water distribution line 112 with cold water from the main water distribution line 104 such that the water provided to the cold water distribution line 108 and distributed throughout the building has its temperature raised to a temperature above that at which water is provided by the water service line 102 or main water distribution line 104. Specifically, the mixer 214 can increase the temperature of the cold water distribution line(s) to a temperature such that condensation is reduced (e.g., prevented or eliminated) on the lines (e.g., pipes or hoses) having cold water flowing therethrough. In some embodiments, the mixer 214 provides water at a temperature equal to the dew point of the ambient air inside the building. In some embodiments, the mixer 214 provides water at a temperature greater than the dew point of the ambient air inside the building. In some embodiments, the mixer 214 provides water at a temperature less than the dew point. For example, where the material of the cold water distribution lines has a relatively low thermal conductivity, the mixer 214 can provide water at a temperature of less than the dew point of the ambient air in the building but at a sufficiently high temperature such that the surfaces of the lines containing the cold water are at a temperature above the dew point of the ambient air. As another example, the mixer 214 can provide water at a temperature less than the dew point of the ambient air in the building where a minimal but nonzero amount of condensation is acceptable, and condensation is reduced, but not entirely prevented or eliminated.

By increasing the temperature of the water at the mixer 214, the system 200 reduces, prevents, or eliminates condensation on the cold water distribution lines 108 downstream from the mixer 214. This can reduce moisture in critical areas of a plumbing system, such as where cold water distribution lines run through the interior of walls and are not accessible, and where ventilation is not available to evacuate moisture. Advantageously, this design allows for installation of the mixer 214 inside of the building, such as in a utility room, which can be easy to access and to retrofit to an existing building. In other embodiments, the mixer 214 can be located in other locations such as further downstream on the cold water distribution lines 108 or further upstream, including prior to the water pressure tank 106, at the entry point of the water service line into the building, or exterior to the building anywhere along a water service line (i.e., in between the water source and the wall of the building or at another point outside of the building, such as where a water service line enters a property).

Figure 3:
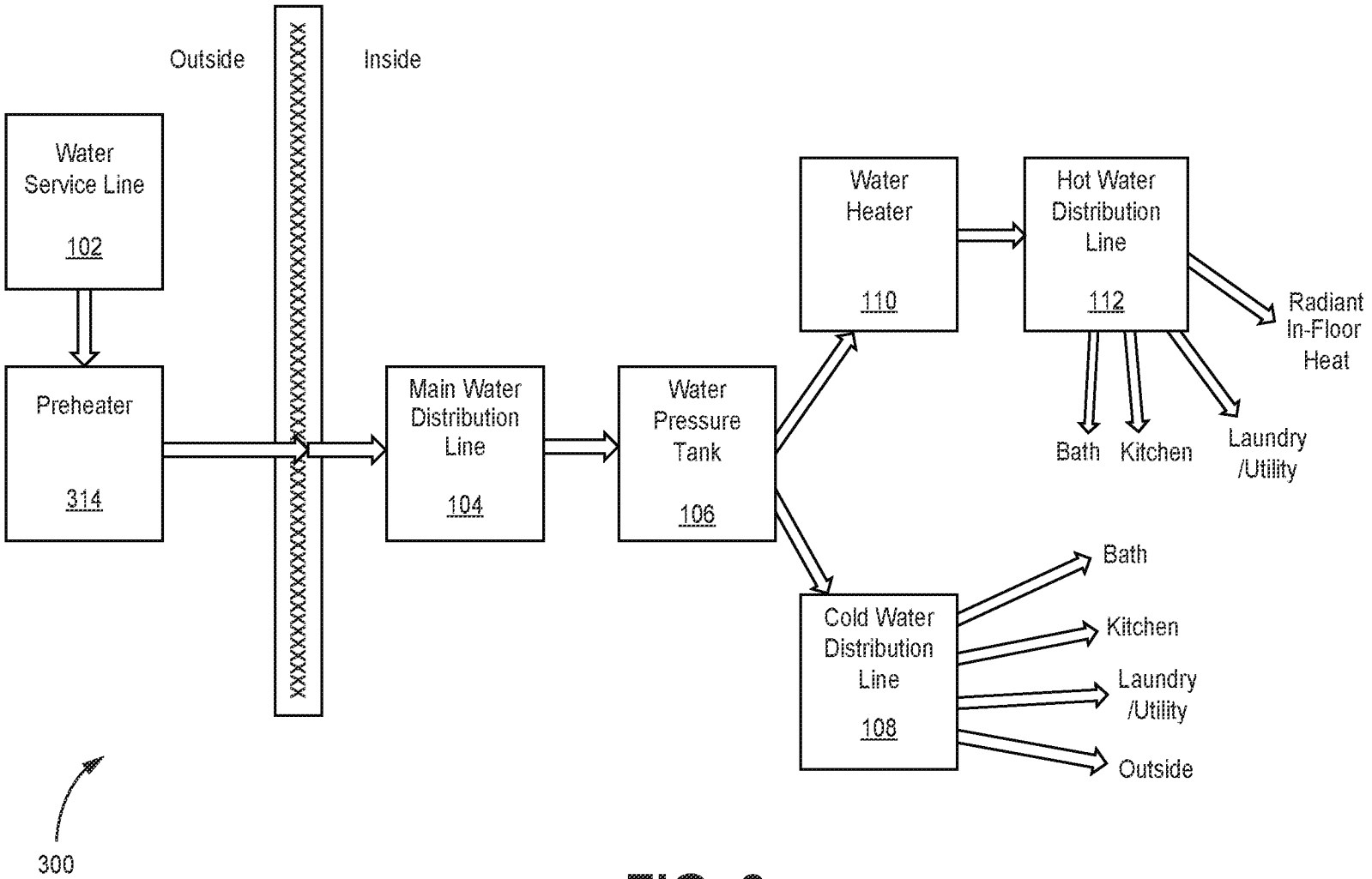
FIG. 3 is a block diagram of a second example plumbing system for reducing condensation.

Turning now to FIG. 3, a block diagram is shown of another example system 300 for reducing, preventing, or eliminating condensation on cold water distribution lines inside a building. The system 300 can include the components and lines of a standard plumbing system 100, such as a water service line 102, main water distribution line 104, water pressure tank 106, cold water distribution line 108, water heater 110, and hot water distribution line 112. The system 200 can further include a preheater 314. The preheater 314 can heat the water provided by the water service line 102 at any point along the water service line to a sufficient temperature such that condensation on the interior cold water distribution lines and fixtures is reduced (e.g., prevented or eliminated). Specifically, the preheater 314 can heat the incoming water to a higher temperature such that condensation is reduced on the distribution lines having cold water flowing therethrough. In some embodiments, the preheater 314 provides water at a temperature equal to the dew point of the ambient air inside the building. In some embodiments, the preheater 314 provides water at a temperature greater than the dew point of the ambient air inside the building. In some embodiments, the preheater 314 provides water at a temperature less than the dew point of the ambient air in the building. For example, where the distribution lines using cold water have relatively low thermal conductivity, the preheater 314 can provide water at a temperature less than the dew point of the ambient air in the building but at a sufficiently high temperature that the surfaces of the lines containing the cold water are at a temperature above the dew point of the ambient air. As another example, the preheater 314 can provide water at a temperature less than the dew point of the ambient air in the building where a minimal but nonzero amount of condensation is acceptable, and condensation is reduced by not entirely prevented or eliminated. Because the system 300 uses a preheater 314 which preheats the water before it enters the house, the system 300 functions to reduce compensation on all cold water distribution lines inside the house. In other examples, the preheater 314 can be located at other positions on the water distribution line, such as inside the building.

Figure 4:
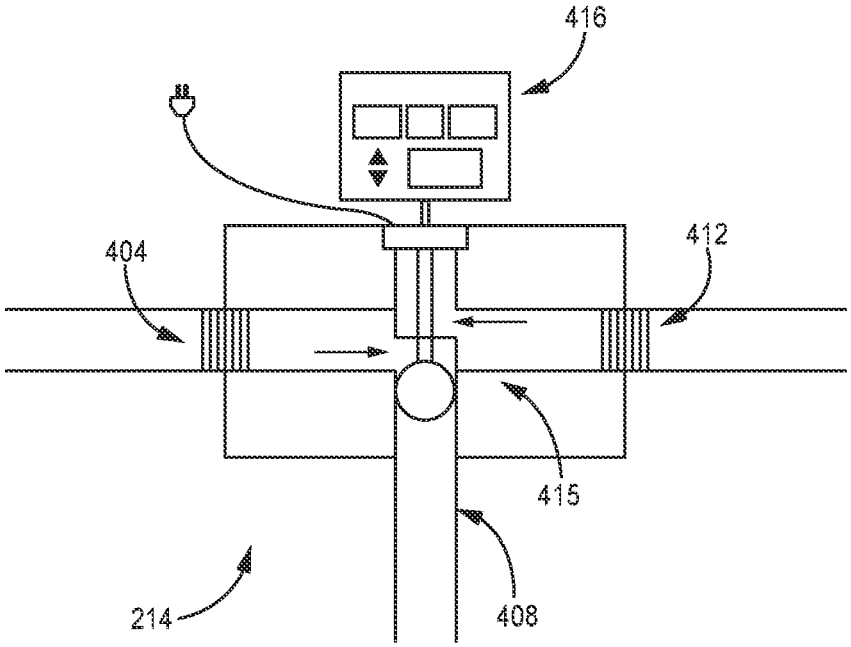
FIG. 4 is a diagram of an example mixer for increasing a temperature of water in water lines based on a dew point.

FIG. 4 is an exemplary mixer 214 in accordance with the various embodiments disclosed herein. In this example, the mixer 214 controls the amount of hot water mixed with the incoming cold water based on the dew point of the surrounding air. The mixer 214 has a cold water inlet 404, a hot water inlet 412, and an outlet 408 for mixed water. The cold water inlet 404 can receive unheated water from a main water distribution line 104. The hot water inlet 412 can receive heated water from a hot water distribution line 112. The outlet 408 can output water to the cold water distribution lines 108. The mixer 214 can control the amount of water from the hot water inlet 412 that is mixed with water from the cold water inlet 404 to provide water at the outlet 408 that is at a set point temperature. The set point temperature can be selected based on sensed dew point measurement(s) such that downstream lines have reduced (e.g., prevented or eliminated) condensation forming thereon, as described above. For example, the water provided from the outlet 408 can be at a temperature that is at or above the dew point of the surrounding air in the building, or is otherwise at a temperature that minimizes or prevents/eliminates condensation on pipes and cold water devices. In some embodiments, the mixer 214 adds a relatively small amount of hot water from the hot water inlet 412 to a larger amount of cold water from the cold water inlet 404. For example, the ratio of mixed cold to hot water can be about 85:15, 90:10, 95:5, higher than 95:5, or lower than 85:15 by volume or volumetric flow rate. In some embodiments, if the cold water from the cold water inlet 404 is at a high enough temperature relative to the ambient dew point (e.g., near, at, or higher than the dew point), the mixer is inactive and does not mix any hot water from the hot water inlet 412 into the cold water from the cold water inlet 404.

The mixer 214 can include a mixing valve assembly 415 including one or more valves (e.g., mixing valves, including three-way mixing valves) for controlling the flow of hot water and/or cold water to produce mixed water at a desired temperature, such as at or above the dew point of the surrounding ambient air. In some embodiments, the mixer includes a valve that controls the flow of hot water from the hot water inlet 412 into the mixer and the amount of cold water from the cold water inlet 404 is unmodulated. In some embodiments, the mixer includes a valve that controls the flow of cold water from the cold water inlet 404 and the flow of hot water from the hot water inlet 412 is unmodulated. In some embodiments, one or more valves can modulate the amount of both the cold water from the cold water inlet 404 and the amount of hot water from the hot water inlet 412. The type of valve(s) used by the mixer 214 is not limited, and can include ball valves, diaphragm valves, and other water valves known in the art.

Actuation of the mixer 214 can be automatic or manual. In some embodiments, mixing can be manually set by a mechanical control such as a dial or knob which can actuate one or more valves of the mixer and control the amount of mixing. For example, a knob can have a temperature scale that a user can manually select in order to provide mixed water at the outlet 408 having a corresponding temperature or temperature offset relative to the dew point or unheated cold water temperature. In this way, a user can manually set a temperature for the outlet water to a desired temperature, such as a temperature at or above the dew point of the interior of the building. A dew point value can be displayed on a display device of the mixer 214 for a user to reference when making manual adjustments. The mixer 214 can also include a controller 416 for controlling the mixer. The controller 416 can have an input allowing for a user to manually set an outlet temperature and the controller can automatically actuate one or more valves of the mixer 214 to achieve the desired water temperature at the outlet 408. The controller 416 can also have an inlet for a user to manually set a temperature offset relative to the dew point, such as a certain number of degrees above or below the dew point, or at the dew point.

The controller 416 can also include or otherwise receive input from one or more dew point sensors. The type of each dew point sensor is not limited, and can include sensors such as one or more hygrometers, temperature sensors, pressure sensors, or other sensors that alone or in combination with each other can determine the dew point of the ambient air. In an example, a dew point sensor is integrated into the mixer 214 for determining the dew point in the location of the mixer. In addition to or instead of having an integrated dew point sensor, the controller can be communicatively coupled (e.g., wirelessly and/or via a communication network) to one or more dew point sensors positioned at one or more locations remote from the mixer 214, such as in another room. The controller 416 can average the dew point values sensed or use the highest of all measured dew point values. The controller 416 can automatically adjust the temperature of the water provided at the outlet 408 to be at a desired temperature relative to the dew point measured from the one or more dew point sensors.

In some embodiments, the controller can automatically set the water temperature of the outlet 408 to be equal to the dew point of the ambient air. In some embodiments, the controller can automatically set the mixed water temperature of the outlet 408 to be greater than the dew point of the ambient air, such as 1 degree, 2 degrees, 3 degrees, 4 degrees, 5 degrees, 6 degrees, 7 degrees, 8 degrees, 9 degrees 10 degrees, or greater than 10 degrees Fahrenheit greater than the dew point. The offset can take into account any calibration uncertainty in the sensors and/or data being provided. The outlet temperature provided by the outlet 408 is generally equal to or greater than the dew point of the ambient air, but in some cases, such as where cold water pipes are insulated or have a relatively low thermal conductivity, the mixer 214 can also be set to a temperature lower than the dew point of the ambient air while still being at a temperature high enough such that the outside surfaces of the pipes or appliances carrying cold water are at a temperature above the dew point. Additionally, the mixer 214 can also be set to a temperature lower than the dew point of the ambient air where a minimal but nonzero amount of condensation is acceptable. Therefore, in some embodiments, the controller can automatically set the mixed water temperature of the outlet 408 to be slightly less than the dew point of the ambient air, such as 1 degree, 2 degrees, 3 degrees, 4 degrees, 5 degrees, 6 degrees, 7 degrees, 8 degrees, 9 degrees 10 degrees, or greater than 10 degrees Fahrenheit less than the dew point. The temperature of the outlet water relative to the dew point of the ambient air can be set by a user. For example, a user with knowledge of the particular types of lines used can set a temperature offset that is appropriate for the system. As but one example, a system using PEX water lines, which have a relatively low thermal conductivity, may keep cold water at a lower temperature than a system using copper pipes, which have a relatively high thermal conductivity. Thus, a system with PEX lines may require a different amount of temperature increase to raise the water temperature to or above the dew point. The controller can also have a preset value to which it controls the water relative to the ambient dew point. For example, providing water from the outlet 408 at a temperature greater than the dew point can generally reduce, eliminate, or prevent condensation regardless of the materials used in the lines that carry the cold water. In an example, the system can include multiple dew point sensors at different locations in a building and can control the mixed water temperature at the outlet 408 such that It is at a temperature at or above the highest dew point measurement received from the dew point sensors.

The mixer 214 can be configured to provide a water temperature from the outlet 408 at a set point regardless of the temperature of the water at the cold water inlet 404 and the temperature of the water at the hot water inlet 412. The mixer can include sensors for sensing one or more of the cold water temperature at the cold water inlet 404, the hot water temperature at the hot water inlet 412, and the water temperature at the outlet 408. Similarly, the mixer can receive input from a temperature sensor on the outside surface of a water line. Using any combination of these sensed temperatures, the controller 416 can incorporate feedback into its control logic to provide the appropriate amount of mixing (e.g., no hot water to 100% hot water) to provide water at the outlet 408 at the desired set point temperature. In some examples, the mixer 214 can measure the cold water temperature at the cold water inlet 404, the hot water temperature at the hot water inlet 412, and determine the mixed water temperature at the outlet based on those measured temperatures and a known mixing ratio (e.g., volumetric flow rate ratio of cold to hot water of 95:5 or another ratio based on valve position). The controller can incorporate any known method of controlling, such as PID control, to provide the desired outlet temperature.

Although the mixer 214 has been described as determining and using a measured dew point value for use in determining the desired output water temperature (i.e., the amount of mixing), it can additionally or alternatively rely on a direct measurement of condensation on a water line. For example, the mixer 214 can detect the presence or absence of water on a line or otherwise quantify condensation on a line, and can incorporate this measurement into the control logic to determine a desired output water temperature (i.e., the amount of mixing) in the manner described above with respect to dew point. In this way, the mixer 214 can determine if condensation is present, and if so, it can increase the output temperature until no more condensation is present.

The controller 416 can include one or more display devices for displaying data to a user. A display can show data from the controller 416 such as outlet temperature set point, measured ambient temperature(s), ambient dew point(s), ambient pressure(s), and ambient relative humidity value(s). The display can comprise one or more screens such as a digital number display, an LCD, or any other screen for displaying data to a user.

The controller 416 can include one or more processing devices for executing computer readable instructions. The instructions are configured to implement the controlling as described herein. The one or more processing devices of the controller 416 can include a microprocessor. The instructions can be stored (or otherwise embodied) on or in an appropriate storage medium or media (such a hard drive or other non-volatile storage) from which the instructions are readable by the processing device(s) for execution thereby. The one or more processing devices can be coupled to the storage medium or media to access the instructions therefrom. The instructions can, when executed by the processing device(s), cause the controller 416 to perform the controlling actions described herein.

The controller 416 can also include memory that is coupled to the processing device(s) for storing instructions (and related data) during execution by the processing device (s). Memory can comprise any suitable form of random-access memory (RAM) now known or later developed, such as dynamic random-access memory (DRAM). Other types of memory can be used. The controller 416 can also include at least one communication interface (e.g., an ethernet port, a wi-fi transceiver, or a Bluetooth transceiver) for communicatively coupling to external device(s) such as mobile phones, personal computers, or other devices.

The instructions or a portion thereof can be stored or otherwise embodied on a computer readable medium that is distinct from any device and can be loaded onto a controller 416. The computer readable media on which the instructions are stored can be any suitable computer readable media such as a magnetic media (e.g., hard disk drive), optical media (e.g., CD, DVD, Blu-Ray disk) or a non-volatile electric media (e.g., solid-state drive, flash media, or EEPROM).

The controller 416 can have an electrical power supply. The electrical power supply can have any suitable form including one or more of a battery, line power (e.g., by way of a standard socket and plug or by a dedicated power run), solar power, or other source.

By way of the communication interface, the controller 416 can communicate with an external device such as a smart phone or personal computer. A user on an external device can remotely control or otherwise command the controller, for example, to set the temperature of the set point for the temperature of the water at the outlet 412. A user on an external device can also view data from the controller 416 such as outlet temperature set point, measured temperature (s), dew point(s), pressure(s), and relative humidity value(s). The controller 416 can also connect to an internet of things (IoT) and act in concert with various environmental controls inside a building to most efficiently and effectively provide for condensation-free or reduced-condensation plumbing. Data collected by the system 600 can be communicated to and stored in a database. In such embodiments, data can be observed over time and analyzed by systems including artificial intelligence (e.g., large language model) to optimize performance (e.g., energy efficiency, effectiveness, etc.) in one or more buildings. Data can be collected on different systems and applied worldwide.

Figure 8:
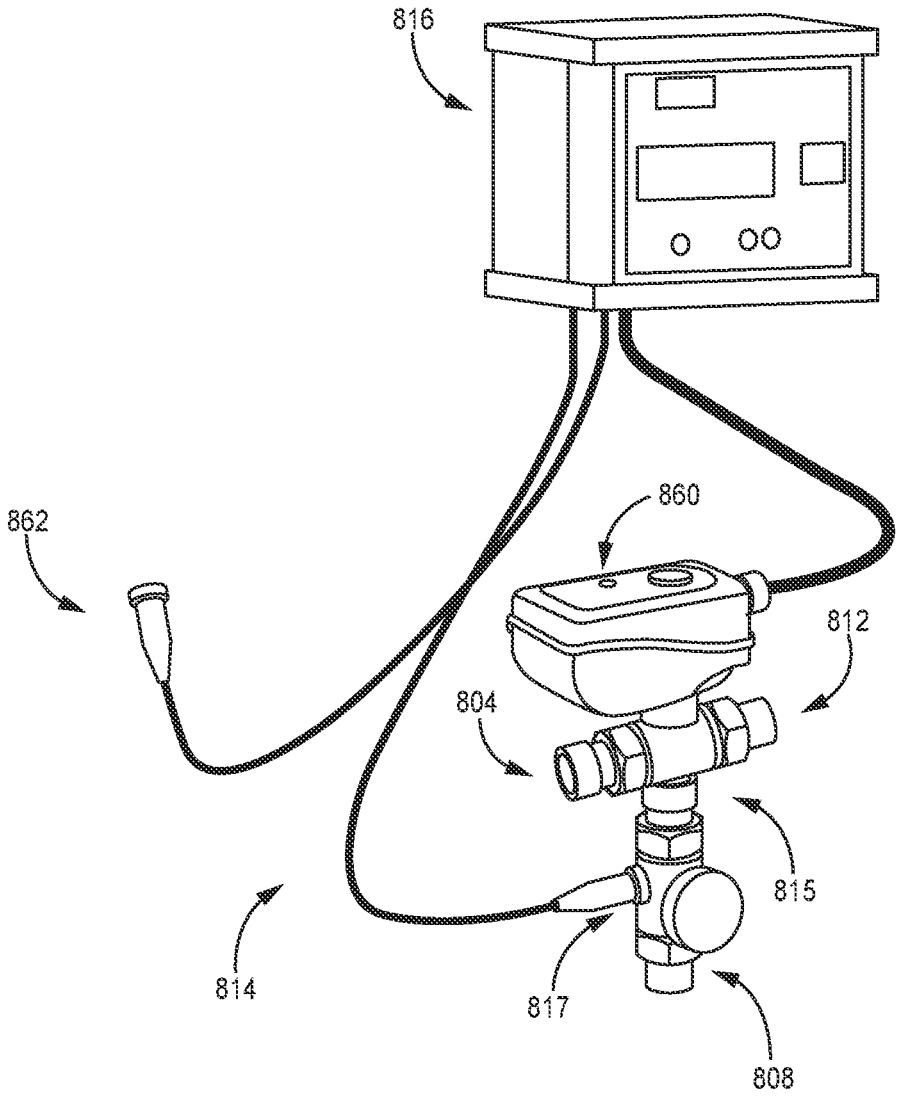
FIG. 8 is a diagram of an example mixer for increasing a temperature of water in water lines based on a dew point.

FIG. 8 depicts another exemplary mixer 814 in accordance with the various embodiments disclosed herein. In this example, the mixer 814 generally has the same features and functionality as the mixers 214 described above with reference to FIG. 4. The mixer 814 has a cold water inlet 804, a hot water inlet 812, and an outlet 808 for mixed water. In this example, the mixer has a controller 816 that is located apart from the mixing valve assembly 815. The controller 816 can be communicatively coupled with the mixing valve assembly 815 via a wired or wireless connection. The controller 816 can be a wall-mounted device. The controller 816 is otherwise consistent with the controllers 416 described above with reference to FIG. 4. The mixer 814 has an actuator 860 for actuating one or more valves of the mixing valve assembly 815. The mixer 814 has an outlet temperature sensor 817 for measuring the temperature of the outlet water and/or the surface of an outlet line. The outlet temperature sensor 817 is communicatively coupled with the controller 816. The mixer 814 also has a second sensor 862. The second sensor 862 can include one or more sensors for measuring one or more parameters relating to the dew point of the air ambient to the second sensor 862, such as a dew point sensor, a relative humidity sensor, a temperature sensor, or any other sensor relating to dew point. The second sensor 862 can also include a sensor for detecting or quantifying the presence of condensation on a cold water distribution line, such as a moisture sensor. The mixer 862 can include more than one second sensor for detecting various parameters consistent with the embodiments disclosed herein.

The preheaters 314 used in the systems disclosed herein and described with reference to FIG. 3 can also have similar features and functionality to the mixer 214 disclosed herein. That is, the preheaters 314 can be configured to heat water provided by a water service line 102 to a temperature that is at or above the dew point inside the building. The preheater 314 can include a heating source for directly heating the water by way of an electric or combustion heat source. The preheater 314 can also include a heat exchanger for heating water with the working fluid of a solar thermal collector.

The preheater 314 can be controlled to heat water to a set point temperature in a similar manner to that described with respect to the mixer 214. Control of the preheater 314 can be automatic or manual. In some embodiments, the temperature set point can be manually set by a mechanical control such as a dial or knob. For example, a knob can have a temperature scale that a user can manually select in order to provide water at a corresponding temperature. In this way, a user can manually set a temperature for the outlet water to a desired temperature, such as a temperature at or above the dew point of the interior of the building. The preheater 314 can also include a controller. The controller can be co-located with the preheater 314 or can be located remotely such as at a location inside the building. The controller can have an input allowing for a user to manually set an outlet temperature and the controller can automatically control the preheater 314 to achieve the desired water temperature. The controller can also have an input for a user to manually set a temperature offset relative to the measured dew point, such as a certain number of degrees above or below the dew point, or at the dew point.

The controller can include or otherwise receive input from one or more dew point sensors. The type of each dew point sensor is not limited, and can include sensors such as one or more hygrometers, temperature sensors, pressure sensors, condensation sensors, or other sensors that alone or in combination with each other can determine the dew point of the ambient air. The controller can include an integral dew point sensor for determining the dew point at the location of the preheater 314, such as when the controller is located inside the building and remotely controls the preheater 314. The controller can also be communicatively coupled to one or more dew point sensors positioned at one or more locations remote from the controller and/or the preheater 314, such as in one or more rooms inside the building. The controller can average the dew point values sensed or use the highest of all measured dew point values. The controller 416 can automatically adjust the temperature of the heated water to be at a desired temperature relative to the dew point measured from the one or more dew point sensors.

In some embodiments, the controller can automatically set the water at the outlet of the preheater 314 to be equal to the dew point of the ambient air. In some embodiments, the controller can automatically set the water temperature to be greater than the dew point of the ambient air, such as 1 degree, 2 degrees, 3 degrees, 4 degrees, 5 degrees, 6 degrees, 7 degrees, 8 degrees, 9 degrees 10 degrees, or greater than 10 degrees Fahrenheit greater than the dew point. The offset can take into account any calibration uncertainty in the sensors and/or data being provided. The heated water temperature is generally set to be equal to or greater than the dew point of the ambient air, but in some cases, such as where cold water pipes are insulated or have a relatively low thermal conductivity, the preheater 314 can also be set to a temperature lower than the dew point of the ambient air while still being at a temperature high enough such that the outside surfaces of the pipes or appliances carrying cold water are at a temperature above the dew point. Additionally, the mixer 214 can also be set to a temperature lower than the dew point of the ambient air where a minimal but nonzero amount of condensation is acceptable. Therefore, in some embodiments, the controller can automatically set the water temperature to be slightly less than the dew point of the ambient air, such as 1 degree, 2 degrees, 3 degrees, 4 degrees, 5 degrees, 6 degrees, 7 degrees, 8 degrees, 9 degrees 10 degrees, or greater than 10 degrees Fahrenheit less than the dew point. The temperature of the water relative to the dew point of the ambient air can be set by a user. For example, a user with knowledge of the particular types of lines used can set a temperature offset that is appropriate for the system. As but one example, a system using PEX lines, which have a relatively low thermal conductivity, may keep cold water at a lower temperature than a system using copper pipes, which have a relatively high thermal conductivity. Thus, a system with PEX lines may require a different temperature increase to raise the water temperature to or above the dew point. The controller can also have a preset value to which it controls the water relative to the ambient dew point. For example, providing water to the outlet 408 at a temperature greater than the dew point will generally prevent condensation regardless of the materials used in the pipes and appliances that carry the cold water. In an example, the system can include multiple dew point sensors at different locations in a building and can control the mixed water temperature at the outlet 408 such that it is at a temperature at or above the highest dew point measurement received from the dew point sensors.

The preheater 314 can be configured to provide a set water temperature regardless of the incoming cold water temperature. The preheater 314 can include sensors for sensing incoming cold water temperature and/or the outlet water temperature. Similarly, the preheater 314 can receive input from a temperature sensor on the outside surface of a pipe or cold water appliance. Using any combination of these sensed temperatures, the controller can incorporate feedback into its control logic to provide the appropriate amount of heating to provide water at the desired setpoint temperature. The controller can incorporate any known method of controlling, such as PID control, to provide the desired outlet temperature. In an example, the preheater 314 can increase the water temperature from zero to thirty-five (35) degrees Fahrenheit.

Although the preheater 314 has been described as determining and using a measured dew point value for use in determining the desired output water temperature (i.e., the amount of heating), it can additionally or alternatively rely on a direct measurement of condensation on a water line. For example, the mixer 214 can detect the presence or absence of water on a line or otherwise quantify condensation on a line, and can incorporate this measurement into the control logic to determine a desired output water temperature (i.e., the amount of heating) in the manner described above with respect to dew point. In this way, the preheater 314 can determine if condensation is present, and if so, it can increase the output temperature until no more condensation is present.

Figure 5:
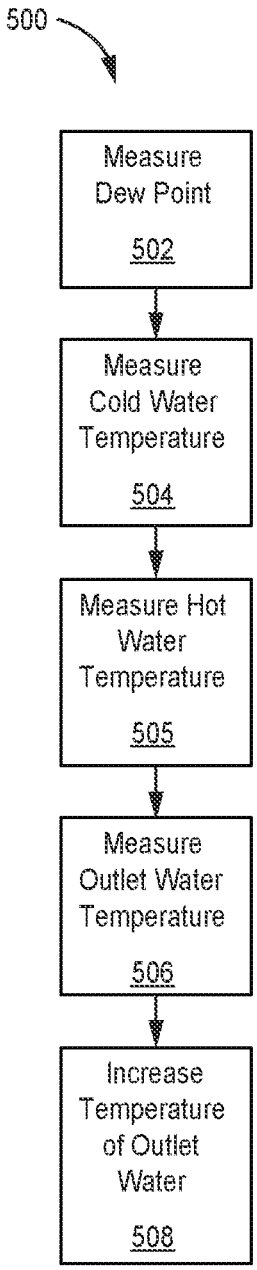
FIG. 5 is a flow diagram of an example method for reducing condensation on water lines in a building.

FIG. 5 depicts a method 500 for reducing condensation on water supply lines in a building. The method 500 can be implemented on the systems described with reference to FIGS. 2 and 3, including any temperature increasing device such as a mixer 214, a preheater 314, or on any other device that can increase the temperature of the water. The method 500 includes determining the dew point of the ambient air 502, determining the inlet water (i.e., cold or unheated) temperature 504, and controlling the outlet water (i.e., dew-point-adjusted water) temperature 506.

At step 502, one or more dew point measurements are obtained. This can include receiving data from or otherwise measuring dew point with a dew point sensor. The type of dew point sensor is not limited, and can include sensors such as one or more hygrometers, temperature sensors, pressure sensors, or other sensors that alone or in combination with each other can determine the dew point of the ambient air. A device implementing the step 502 (e.g., mixers, preheaters, heaters, etc.) can include an integral dew point sensor for determining the dew point in the location of the device. Alternatively or additionally, a device (e.g., mixer 214, preheater 314) implementing step 502 can be communicatively coupled to one or more dew point sensors positioned at one or more locations remote from the device, such as in another room. In some examples, the device can calculate an average dew point value over time and/or amongst measurements from a plurality of dew point sensors. In some examples, the device can identify the highest of all measured dew point values over a period of time and/or amongst measurements from a plurality of dew point sensors.

In an example, at block 504, the method 500 can measure a water temperature 504 prior to the device increasing the temperature (also referred to herein as the inlet cold water temperature). Measuring an inlet cold water temperature 504 can include measuring or otherwise determining the temperature of water at an inlet of the temperature increasing device or at another location upstream of such a device. A device increasing the water temperature can include one or more sensors for sensing the cold water temperature at the cold water inlet. Suitable sensors are not limited and can include, for example, thermocouples and other temperature sensors known in the art. The water temperature can be measured directly, such as by a sensor in contact with the water, or indirectly, such as by a sensor on the outside of a line or other vessel conveying the water (e.g., on an outside surface of a line). In an example, the inlet cold water temperature is in the range of 40 to 70 degrees Fahrenheit.

In an example, at step 505, the method 500 can measure a water temperature of hot water being used to increase the temperature (also referred to herein as the inlet hot water temperature). Measuring an inlet hot water temperature can include measuring or otherwise determining the temperature of water at a hot water inlet of a mixer or at an inlet of a heat exchanger for a preheater. A device increasing the water temperature can include one or more sensors for sensing the inlet hot water temperature. Suitable sensors are not limited and can include, for example, thermocouples and other temperature sensors known in the art. The water temperature can be measured directly, such as by a sensor in contact with the water, or indirectly, such as by a sensor on the outside of a line or other vessel conveying the water. In an example, the inlet hot water temperature is in the range of 80 to 140 degrees Fahrenheit.

In an example, at step 506, the method 500 can measure a water temperature output from the device increasing the temperature (also referred to herein as the "outlet" water temperature). Measuring an outlet water temperature 504 can include measuring or otherwise determining the temperature of water at the outlet of a device implementing the method or at another location downstream of such a device. A device increasing the water temperature can include one or more sensors for sensing the cold water temperature at the cold water outlet. Suitable sensors are not limited and can include, for example, thermocouples and other temperature sensors known in the art. The water temperature can be measured directly, such as by a sensor in contact with the water, or indirectly, such as by a sensor on the outside of a line or other vessel conveying the water (i.e., on an outside surface of the line). In some embodiments, rather than measuring the temperature of the outlet, one or more sensors is used to detect and/or quantify an amount of condensation on the line(s).

Although the method 500 has been described with the steps of measuring cold water inlet temperature 504, measuring hot water inlet temperature 505, and measuring outlet water temperature (or condensation) 506, any combination of these measurements can be included in the method 500. In some embodiments, only the step of measuring outlet water temperature 506 is conducted. In some embodiments, the only measurement is the detection of condensation on an outlet line. In some embodiments, no measurements are taken and the method 500 operates as an open loop system.

At step 508, the method 500 includes increasing the outlet water temperature based on the one or more dew point measurements. The outlet water temperature is generally increased to be at a set point relative to the dew point measured or otherwise calculated (e.g., averaged, highest selected) at the step 502. Devices used for controlling the outlet water temperature can include mixers and preheaters, as described above, or any other device for controlling water temperature. For example, dedicated water heaters can be used for adjusting the water temperature according to the method 500.

In some embodiments, the step of increasing the outlet water temperature comprises increasing the outlet water to a temperature equal to the dew point measured or otherwise calculated (e.g., averaged, highest selected) at step 502. In some embodiments, the step 508 comprises increasing a temperature of the outlet water to a temperature greater than the dew point obtained in step 502, such as 1 degree, 2 degrees, 3 degrees, 4 degrees, 5 degrees, 6 degrees, 7 degrees, 8 degrees, 9 degrees 10 degrees, or greater than 10 degrees Fahrenheit greater than the dew point. The offset can take into account any calibration uncertainty in the sensors and/or data being provided. In an example, step 508 increases the outlet water temperature so that it is provided at a temperature equal to or greater than the dew point of the ambient air. In other examples, such as where cold water distribution lines are insulated or have a relatively low thermal conductivity, the outlet water can also be set to a temperature lower than the dew point obtained at step 502 while still being at a temperature high enough such that the outside surfaces of the lines or fixtures carrying cold water are at a temperature above the dew point. Additionally, the mixer 214 can also be set to a temperature lower than the dew point of the ambient air where a minimal but nonzero amount of condensation is acceptable. Therefore, in some embodiments, the step 508 comprises providing outlet water at a temperature slightly less than the dew point obtained at step 502, such as 1 degree, 2 degrees, 3 degrees, 4 degrees, 5 degrees, 6 degrees, 7 degrees, 8 degrees, 9 degrees 10 degrees, or greater than 10 degrees Fahrenheit less than the dew point. The offset can take into account any calibration uncertainty in the sensors and/or data being provided. In example, the temperature of the outlet water relative to the dew point can be set by a user. For example, a user with knowledge of the particular types of lines or fixtures used can set a temperature offset that is appropriate for the system. As but one example, during a low-flow rate condition, a system using PEX lines, which have a relatively low thermal conductivity, may keep cold water at a lower temperature than a system using copper pipes, which have a relatively high thermal conductivity. Thus, a system with PEX lines may require a higher temperature increase to raise the water temperature to or above the dew point. The controller can also have a preset value to which it controls the water relative to the ambient dew point. For example, providing water to the outlet 408 at a temperature greater than the dew point will generally prevent condensation regardless of the materials used in the lines that carry the cold water. In an example, the method controls the outlet water to have a temperature in the range of 40 to 75 degrees Fahrenheit, that is, the set point is at a temperature in the range of 40 to 75 degrees Fahrenheit.

In an example, the system can control the mixed water temperature at the outlet 408 such that it is at a temperature at or above the highest dew point measurement received from one or more dew point sensors or dew point values received from a remote sensor or other source such as a weather station. The step 508 can incorporate feedback to control the outlet water to be at the desired setpoint temperature. For example, one or more sensors for determining the temperature of the outlet water and/or the inlet water can provide input to determine how much to increase the temperature of the water and/or whether the desired setpoint is attained. For example, if the outlet water temperature is higher than desired, the water can be heated less (e.g., less hot water will be mixed into the cold water stream). Conversely, if the outlet water temperature is lower than desired, the water can be heated more (e.g., more hot water will be mixed into the cold water stream). The step 508 can incorporate any known control method, such as PID control, to provide the desired outlet temperature. Suitable sensors for determining outlet water temperature are not limited and can include, for example, thermocouples and other temperature sensors. The water temperature can be measured directly, such as by a sensor in contact with the water, or indirectly, such as by a sensor on the outside of a line conveying the water. As another example, one or more sensors for detecting the presence of and/or quantifying an amount of condensation or moisture on a water line can provide input to determine how much to increase the temperature of the water and/or whether the desired setpoint is attained. For example, if there is no condensation detected, the water can be heated less (e.g., less hot water will be mixed into the cold water stream). Conversely, if the system detects the presence of condensations, the water can be heated more (e.g., more hot water will be mixed into the cold water stream). Suitable sensors for determining condensation are not limited and can include, for example capacitive or resistive condensation detectors.

Figure 6:
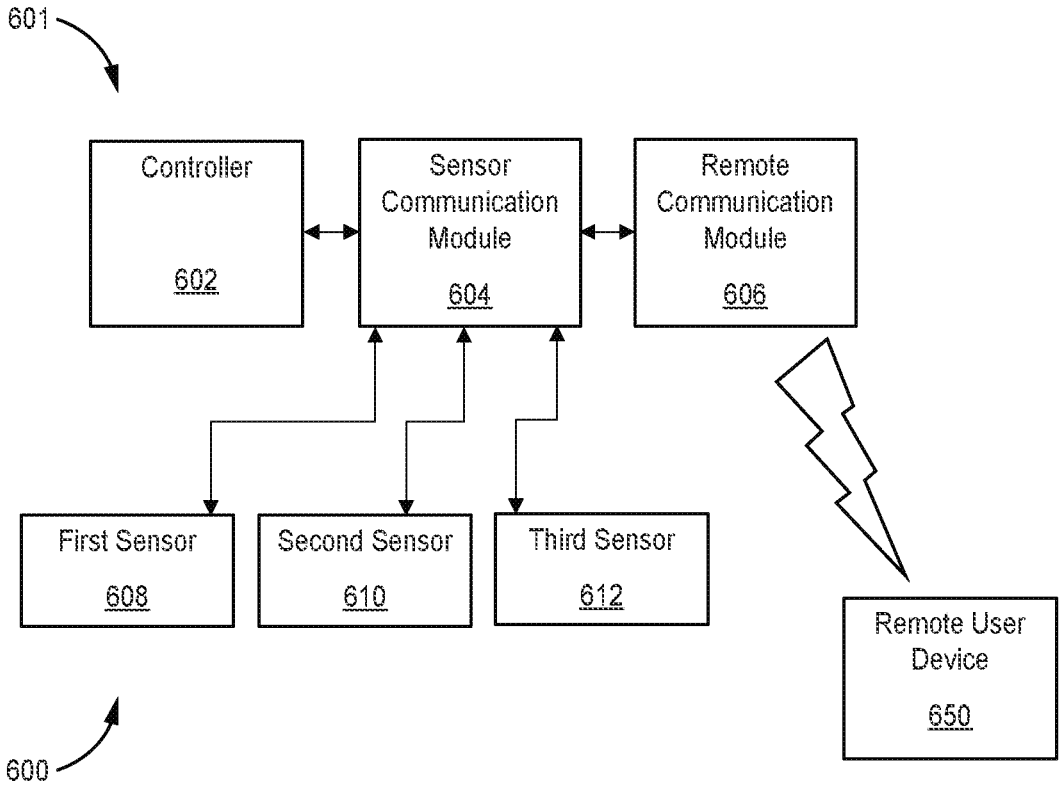
FIG. 6 is a block diagram of an example system for monitoring a pipe condition.

FIG. 6 depicts an exemplary system 600 for monitoring a pipe condition including a monitoring device 601. The device 601 comprises a controller 602, a sensor communication module 604, and a remote communication module 606. The system 600 can also include one or more sensors including a first sensor 608, a second sensor 610, and a third sensor 612. In some embodiments, one or more of these sensors are a part of or collocated with the device 601, and in some embodiments, one or more of these sensors are remote from the device 601. The system 600 can also include a remote user device 650 in communication with the monitoring device 601.

The controller 602 controls the sensor communication module 604 and remote communication module 606. The sensor communication module 604 enables the device 601 to communicate with one or more sensors, including the first sensor 608, second sensor 610, and third sensor 612. Communication methods are not limited and can include known wired or wireless communication protocols, including ethernet, Bluetooth, Wi-Fi, and cellular. The remote communication module enables the device 601 to communicate with a remote user device 650, such as a mobile phone or personal computer. Communication methods are not limited and can include known wired or wireless communication protocols, including ethernet, Bluetooth, Wi-Fi, and cellular.

Any of the first sensor 608, the second sensor 610, and the third sensor 612 can be temperature sensors, humidity sensors, dew point sensors, pressure sensors, moisture sensors, condensation sensors or any sensors used alone or in combination to determine a condensation condition, such as whether condensation is present on a pipe or likely to be present on a pipe, or whether condensation formation is imminent.

The controller 602 can receive data from the sensors and determine whether a threshold condition relating to pipe condensation is met, consistent with the method described below with reference to FIG. 7. The device 601 can communicate with the remote user device 650 when conditions are met, and as an example, cause an alert to be triggered on the remote user device 650. In some embodiments, data from the sensors is communicated to a remote user device, where the threshold condition determination is made and any alerts are triggered. The controller 602 can communicate with the remote user device 650 by way of the remote communication module 606. A user on a remote user device 650 can remotely control or otherwise command the controller, for example, to set alert thresholds or change other settings. A user on an external device can also view data from the controller 602 such a measured temperature(s), dew point(s), pressure(s), and relative humidity value(s), and moisture content(s). The controller 606 can also connect to an internet of things (IoT) and act in concert with various environmental controls inside a building to most efficiently and effectively provide for condensation-free plumbing. The alerting functionality can also occur on one or more user interfaces on the device 601 itself. Data collected by the system 600 can be communicated to and stored in a database. In such embodiments, data can be observed over time and analyzed by systems including artificial intelligence (e.g., large language model) to optimize performance (e.g., energy efficiency, effectiveness, etc.) in one or more buildings. Data can be collected on different systems and applied worldwide.

The controller 602 can include one or more processing devices for executing computer readable instructions. The instructions are configured to implement the controlling as described herein. The one or more processing devices of the controller 602 can include a microprocessor. The instructions can be stored (or otherwise embodied) on or in an appropriate storage medium or media (such a hard drive or other non-volatile storage) from which the instructions are readable by the processing device(s) for execution thereby. The one or more processing devices can be coupled to the storage medium or media to access the instructions therefrom. The instructions can, when executed by the processing device(s), cause the controller 602 to perform the controlling actions described herein.

The controller 602 can also include memory that is coupled to the processing device(s) for storing instructions (and related data) during execution by the processing device (s). Memory can comprise any suitable form of random-access memory (RAM) now known or later developed, such as dynamic random-access memory (DRAM). Other types of memory can be used. The controller 416 also includes at least one communication interface (e.g., an ethernet port, a wi-fi transceiver, or a Bluetooth transceiver) for communicatively coupling to external device(s) such as mobile phones, personal computers, or other devices.

The instructions or a portion thereof can be stored or otherwise embodied on a computer readable medium that is distinct from any device and can be loaded onto a controller 602. The computer readable media on which the instructions are stored can be any suitable computer readable media such as a magnetic media (e.g., hard disk drive), optical media (e.g., CD, DVD, Blu-Ray disk) or a non-volatile electric media (e.g., solid-state drive, flash media, or EEPROM).

The controller 602 can have an electrical power supply. The electrical power supply can have any suitable form including one or more of a battery, line power (e.g., by way of a standard socket and plug or by a dedicated power run), solar power, or other source.

Figure 7:
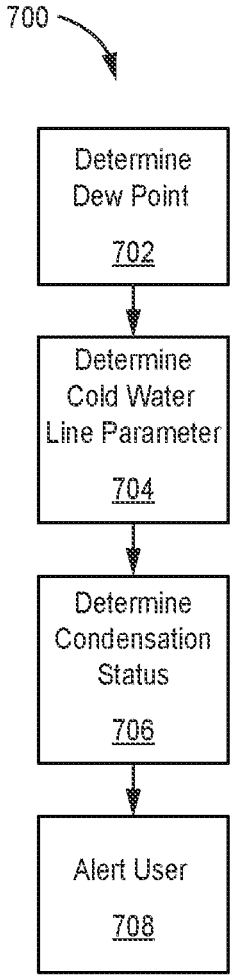
FIG. 7 is a flow diagram of an example method for alerting a user of a condensation status of water lines in a building.

FIG. 7 depicts a method 700 for monitoring condensation on water supply lines in a building. The method 700 can be implemented on the systems described with reference to FIGS. 2 and 3, and can be implemented using temperature increasing device such as a mixer 214, a preheater 314, or any other device that can increase the temperature of the water flowing through a cold water line. The method can also be implemented on a system that does not adjust water temperature, such as a monitoring system 600. The method 700 includes determining the dew point of the ambient air 702, determining a parameter of the cold water line 704, and determining a condensation status 706, and alerting a user 708.

At step 702, one or more dew point measurements are obtained. This can include receiving data from or otherwise measuring dew point with a dew point sensor. The type of dew point sensor is not limited, and can include sensors such as one or more hygrometers, temperature sensors, pressure sensors, or other sensors that alone or in combination with each other can determine the dew point of the ambient air. A device implementing the step 702 (e.g., mixer 214, preheater 314, or monitoring system 600, etc.) can include an integral dew point sensor for determining the dew point in the location of the device. Alternatively or additionally, a device (e.g., mixer 214, preheater 314, or monitoring system 600) implementing step 702 can be communicatively coupled to one or more dew point sensors positioned at one or more locations remote from the device, such as in another room. In some examples, the device can calculate an average dew point value over time and/or amongst measurements from a plurality of dew point sensors. In some examples, the device can identify the highest of all measured dew point values over a period of time and/or amongst measurements from a plurality of dew point sensors.

At step 704, the method 700 can measure a parameter of a cold water distribution line. In some embodiments, this includes measuring the temperature of water inside a cold water distribution line. In some embodiments, this includes measuring the temperature of a pipe of a cold water distribution line. In some embodiments, this includes measuring or detecting moisture (e.g., condensation) on a pipe of a cold water distribution line. The parameter measured at step 704 is generally one that can indicate whether the surface temperature of a cold water distribution line is at or below the dew point of the surrounding air, or whether condensation has formed or is about to form on the cold water lines.

At step 704, the parameter (e.g., water temperature, pipe temperature, condensation amount) can be measured at the location of a device implementing the method (e.g., mixer 214, preheater 314, or monitoring system 600) or at another location remote from such a device. The device can have sensors built into the device and/or it can communicate with remote sensors external to the device.

At step 708, the method 700 includes determining a condensation status. This generally includes determining whether there is or is not condensation present or likely present on a cold water distribution line, or whether the risk of condensation forming is present. This can include determining whether the parameter measured at step 706 has exceeded a threshold. In some embodiments, the step 708 includes determining that the measured water temperature inside a cold water line is near, at, or below a threshold. The threshold can be an ambient dew point such as that measured in the step 702. The threshold can also be an offset from said dew point, such as 1, 2, 3, 4, or 5 degrees above or below the dew point. The offset can take into account any calibration uncertainty in the sensors and/or data being provided. In some embodiments, the step 708 includes determining that the measured pipe temperature on a cold water line is near, at, or below a threshold. The threshold can be an ambient dew point such as that measured in the step 702. The threshold can also be an offset from said dew point, such as 1, 2, 3, 4, or 5 degrees above or below the dew point. The offset can take into account any calibration uncertainty in the sensors and/or data being provided. In some embodiments, the step 708 includes determining that an amount of condensation or moisture on a cold water line is near, at, or below a threshold. The threshold can be the amount of moisture, such as a percentage of area covered by condensation (e.g., a percentage of the surface area of a pipe that has detectable moisture on it). For example, the threshold could be greater than 1%, 5%, 10%, 15%, 25% 50%, 75% or 99% moisture or wetness by area. The offset can take into account any calibration uncertainty in the sensors and/or data being provided. At step 708, the method 700 includes alerting a user based on the determination of condensation status 706. This generally informs a user of a condensation risk. For example, the alert can inform a user that condensation is present on a cold water distribution line, that condensation is likely to form on a cold water distribution line, or that a pipe temperature is at or near a threshold at which condensation may form if no further action is taken. The alert can be an electronic notification sent, for example, to a user's phone, an audible alert (e.g., siren), visual alert (light), or any other suitable alert.

Various valves have been described for use in various systems and methods disclosed herein. The particular types of valves used in these devices are not limited. Exemplary valves can include mixing valves, pressure-balancing valves, 3-way valves, ball valves, globe valves, diaphragm valves, any valve that controls water flow or mixes water, or any other valves known in the art. These valves can be manually or automatically actuated.

Various sensors for measuring dew point have been described for use in the various systems and methods disclosed herein. The particular types of dew point sensors used in these systems are not limited. Exemplary sensors can include dew point hygrometers, psychrometers, infrared (IR) hygrometers, chilled mirror hygrometers, electronic hygrometers, and any other sensors for measuring dew point known in the art. Additionally, in place of a sensor, dew point information can be provided from weather stations, third party sources, or other sensors that provide data from which the dew point can be calculated or otherwise determined. Although various embodiments described herein have been described with reference to a dew point of "ambient air" in a building, a dew point measurement or value provided by a third-party source, such as a weather station or online source, can be used as an approximation for the dew point inside the building. Thus, the embodiments disclosed herein can treat a dew point value provided by a third party, such as a weather station or online source, as the same as a dew point of "ambient air" inside the building in which the system is implemented.

Various sensors for measuring temperature have been described for use in the various systems and methods disclosed herein. The particular types of temperature sensors for measuring water, pipe surface, air, or other temperatures are not limited. Exemplary temperature sensors can include infrared thermometers, thermal imaging cameras, contact thermometers including thermocouples, thermistors, resistance temperature devices (RTDs), and thermopiles, surface temperature probes, infrared cameras, and other temperature sensors or methods of measuring temperature known in the art. As but one example, a temperature sensor can be a k-type thermocouple configured to measure the temperature of a pipe surface.

Various sensors for measuring condensation or moisture on a surface have been described for use in the various systems and methods disclosed herein. The particular types of sensors for measuring condensation or moisture on surfaces, such as pipe surfaces, are not limited. Exemplary condensation sensors include humidity sensors such as capacitive or resistive sensors, which can measure the relative humidity of air, which can in turn be compared to pipe temperature to detect condensation. Other examples include dew point monitors, which can directly measure the dew point of the air and can in turn be compared to pipe temperature to detect condensation. Other examples include surface condensation detectors such as those using temperature and moisture sensors and known methods to detect condensation. Other examples include thermal imaging cameras, which can detect pipes with low temperatures and can in turn be compared to a dew point measurement to detect condensation. Other sensors such as moisture sensors capable of detecting or determining or predicting the presence of condensation on a surface can be used.

Although the various systems and methods described herein have focused on controlling the temperature cold water distribution lines to reduce condensation by raising the surface temperature of the pipes to at or above the dew point, the systems and methods can also be used to reduce condensation to an acceptable, nonzero amount by allowing pipe surfaces to be at temperatures lower than the ambient dew point, but high enough so that only the condensation is not sufficient to cause damage.

Any of the systems and methods disclosed herein for measuring a condensation condition (e.g., relative humidity, pipe temperature, water temperature, moisture content) and/or for controlling cold water line temperature (e.g, mixers or preheaters) can be configured to take into account potential calibration uncertainty with any of the sensors or data inputs. For example, such devices for controlling water temperature can maintain a temperature setpoint at a certain offset. Any such devices can also have a programmed-in delay such that control of a cold water line temperature is not immediate, but offset. For example, when a system detects that a condensation condition is present on a cold water line, the system can delay making any changes for a set amount of time. Such a delay could factor in the time it takes for excessive condensation levels to form on a pipe. For example, when a system detects a pipe temperature is at or below the ambient dew point, it could delay heating the cold water line for 1, 2, 3, 4, 5, or more minutes after detecting the condition.

Any of the systems and methods disclosed herein for measuring a condensation condition (e.g., relative humidity, pipe temperature, water temperature, moisture content) and/or for controlling cold water line temperature (e.g., mixers or preheaters) can be configured to limit heating of cold water distribution lines to a set amount. This can prevent an overheating condition in order to comply with any applicable code requirements, pipe or cold water device specifications, or other requirements such as minimizing the amount of water that must be heated. As an example, the system can limit cold water to a certain temperature, for example 50 degrees, 60 degrees, 70 degrees, 80 degrees, 90 degrees, or 100 degrees Fahrenheit, even if the dew point is higher than the maximum temperature.

The term "line" used herein can refer to any conveyance for carrying water in a plumbing system, such as pipes, hoses, tubes, or other lines. The lines can be made from any material including copper, cross-linked polyethylene ("PEX"), PVC, galvanized steel, cast iron, or any other material that can be used in a water line.

The various systems and methods for reducing or eliminating condensations described herein can incorporate artificial intelligence (AI) or other methods of data analysis. For example, AI can be used to determine optimal parameters for a system, such as desired output temperatures to reduce or eliminate condensation while using a minimal amount of hot water, and thus energy, to achieve a desired result. AI could be used to determine an amount of time to delay taking action after detecting a condensation condition. AI could be used to determine the usage habits of a building or group of buildings in a location with a similar climate and predictively control the systems for reducing or eliminating condensation. The systems can record data and transmit it to a remote server that can analyze it and perform these functions. Any of the features and functions of the systems and methods described herein can be optimized or otherwise affected by results of an AI or other data analysis.

The invention claimed is:

1. A system for reducing condensation on a water line of a building, the system comprising:

a manifold defining:

a first inlet configured to be connected to a cold water line of a building for receiving cold water from the cold water line;

a second inlet configured to be connected to a hot water line of the building for receiving hot water from the hot water line; and an outlet configured to be connected to the cold water line of the building for providing water to the cold water line; and a body fluidly coupling the first inlet and the second inlet to the outlet;

the manifold further including:

a valve configured to control the flow of hot water through the manifold between the second inlet and the outlet; and an actuator configured to adjust the valve, wherein the manifold is a single unit that is configured to be connected to the first, second and third water lines;

a first sensor configured to obtain measurements indicative of a dew point of ambient air;

a second sensor configured to obtain measurements indicative of a temperature of water at the outlet; and a controller coupled to the first sensor and the actuator, the controller including one or more processing devices and a storage medium having instructions thereon, the instructions, when executed by the one or more processing devices, cause the one or more processing devices to control the actuator to adjust a quantity of hot water that is mixed with cold water in the manifold based on one or more measurements from the first sensor and one or more measurements from the second sensor.

2. The apparatus of claim 1, wherein the instructions cause the one or more processing devices to control the actuator such that measurements from the second sensor indicate that a temperature of water at the outlet is greater than the dew point.

3. The apparatus of claim 1, further comprising a third sensor for detecting condensation on a line downstream from the outlet, wherein the instructions cause the one or more processing devices to control the actuator to adjust the quantity of hot water that is mixed with cold water in the manifold based on one or more measurements from the first sensor, one or more measurements from the second sensor, and one or more condensation measurements from the third sensor.

4. The apparatus of claim 3, wherein the instructions cause the one or more processing devices to control the actuator such that condensation measurements from the third sensor indicate that condensation is not detected.

5. The apparatus of claim 1, wherein the controller comprises a user interface for receiving inputs that cause the controller to execute instructions that cause the quantity of hot water that is mixed with cold water to be set such that a desired temperature of water at the outlet relative to the dew point is set.

6. The apparatus of claim 1, wherein the controller is configured to communicate with a remote user device for receiving inputs that cause the controller to execute instructions that cause the quantity of hot water that is mixed with cold water to be set such that a desired temperature of water at the outlet relative to the dew point is set.

7. A method of reducing condensation on a water line of a building, the method comprising:

determining, using one or more processing devices and a storage medium having instructions thereon, a dew point of ambient air;

receiving, at a first inlet, water from a cold water line of the building at a first temperature;

converting power from a power source to heat;

transferring the heat to the water;

controlling the converting power to heat using the one or more processing devices executing instructions stored on the storage medium, to provide water at an outlet, to the cold water line of the building, at a second temperature according to a setpoint, wherein the setpoint is based on the dew point.

8. The method of claim 7, wherein the setpoint is higher than the dew point of the ambient air.

9. The method of claim 7, wherein the setpoint is equal to the dew point of the ambient air.

10. The method of claim 7, wherein the setpoint is less than the dew point of the ambient air.

11. The method of claim 7, wherein determining a dew point comprises communicating with a sensor using the one or more processing devices executing instructions stored on the storage medium.

12. The method of claim 7, wherein determining a dew point comprises receiving a dew point value from third-party source using the one or more processing devices executing instructions stored on the storage medium.

13. A water heating device for a water line of a building comprising:

a first inlet configured to be connected to a cold water line of the building for receiving water at a first temperature from the cold water line of the building;

an outlet configured to be connected to the cold water line of the building for providing water to the cold water line of the building;

a heating device configured to convert power from a power source to heat and transfer the heat to water received at the first inlet and provide heated water at the outlet;

a controller coupled to the heating device, the controller including one or more processing devices and a storage medium having instructions thereon where the instructions, when executed by the one or more processing devices, cause the one or more processing devices to control the heating device to adjust the amount of power converted to heat based on one or more dew point measurements received by the controller to provide heated water at a second temperature.

14. The heating device of claim 13, wherein the heating device is configured to convert electricity to heat.

15. The heating device of claim 13, wherein the heating device is configured to convert a combustion source to heat.

16. The heating device of claim 13, further comprising a remote communication module for communicating with a remote user device.

17. The heating device of claim 16, wherein the controller can be controlled based on input from a remote user device.

18. The system of claim 1, wherein the second sensor is part of the single unit manifold.

19. The system of claim 1, wherein the valve is a three-way valve configured to control the flow of cold water through the manifold and the flow of hot water through the manifold.

* * * * *